US009024840B2

(12) United States Patent
Henderson et al.

(10) Patent No.: US 9,024,840 B2
(45) Date of Patent: May 5, 2015

(54) ANTENNA STRUCTURE

(75) Inventors: Robert Ian Henderson, Chelmsford (GB); James Christopher Gordon Matthews, Chelmsford (GB)

(73) Assignee: BAE SYSTEMS plc, London (GB)

( * ) Notice: Subject to any disclaimer, the term of this patent is extended or adjusted under 35 U.S.C. 154(b) by 120 days.

(21) Appl. No.: 13/702,328

(22) PCT Filed: Jun. 29, 2011

(86) PCT No.: PCT/GB2011/000985

§ 371 (c)(1),
(2), (4) Date: Dec. 6, 2012

(87) PCT Pub. No.: WO2012/001359

PCT Pub. Date: Jan. 5, 2012

(65) Prior Publication Data

US 2013/0093633 A1 Apr. 18, 2013

(30) Foreign Application Priority Data

Jun. 30, 2010 (EP) ..... 10275068
Jun. 30, 2010 (GB) ..... 1010982.5

(51) Int. Cl.

| | |
|---|---|
| ***H01Q 1/36*** | (2006.01) |
| ***H01Q 1/27*** | (2006.01) |
| ***H01Q 1/38*** | (2006.01) |
| ***H01Q 9/27*** | (2006.01) |

(52) U.S. Cl.

CPC ..... *H01Q 1/273* (2013.01); *H01Q 1/36* (2013.01); *H01Q 1/38* (2013.01); *H01Q 9/27* (2013.01)

(58) Field of Classification Search

CPC ..... H01Q 1/273; H01Q 1/36; H01Q 1/38; H01Q 9/27
USPC ..... 343/718, 702, 895
See application file for complete search history.

(56) References Cited

U.S. PATENT DOCUMENTS

| | | | | |
|---|---|---|---|---|
| 5,621,422 | A * | 4/1997 | Wang | 343/895 |
| 5,815,122 | A | 9/1998 | Nurnberger et al. | |
| 6,137,453 | A * | 10/2000 | Wang et al. | 343/895 |
| 6,750,828 | B1 * | 6/2004 | Wixforth et al. | 343/895 |
| 2002/0024474 | A1 | 2/2002 | Chen | |

(Continued)

FOREIGN PATENT DOCUMENTS

| | | | |
|---|---|---|---|
| CN | 1316796 | A | 10/2001 |
| DE | 202007006339 | U1 | 8/2007 |
| WO | 9725755 | A1 | 7/1997 |
| WO | 2008008775 | A2 | 1/2008 |

OTHER PUBLICATIONS

International Preliminary Report on Patentability and Written Opinion for PCT/GB2011/000986, mailed Jan. 17, 2013, 4 pages.

(Continued)

*Primary Examiner* — Hoanganh Le
(74) *Attorney, Agent, or Firm* — Finch & Maloney PLLC

(57) ABSTRACT

A wearable antenna assembly incorporates a coplanar waveguide feed in one of the arms of a two-arm spiral antenna. The antenna has relatively high impedance compared with the feed line from a suitable radio but the coplanar waveguide feed is simply modified to provide a quarter-wave transformer adjacent to the feed connection to the antenna and at least one further impedance transformation step on a tangential extension of the feed at the outer edge of the spiral antenna.

15 Claims, 7 Drawing Sheets

(56) References Cited

U.S. PATENT DOCUMENTS

| | | | | |
|---|---|---|---|---|
| 2002/0175879 | A1* | 11/2002 | Sabet et al. | 343/895 |
| 2004/0056812 | A1 | 3/2004 | Sabet et al. | |
| 2009/0009399 | A1 | 1/2009 | Gaucher et al. | |

OTHER PUBLICATIONS

Muller D.J. et al: "Design and Analysis of a 3-Arm Spiral Antenna," IEEE Transactions on Antennas and Propagation, IEEE Service Center, vol. 55, No. 2, pp. 258-266, Feb. 1, 2007.

International Search Report and Written Opinion mailed Aug. 19, 2011OF PCT/GB2011/000985, 9 pages.

IRE Transactions on Antennas and Propagation, vol. 7, Issue 2, 1959, J. Dyson, The Equiangular Spiral Antenna (Apr. 1959).

J.A. Dobbins et al., IEEE Antennas and Propagation Society International Symposium 2006, "Fabric Equiangular Spiral Antenna," pp. 2113-2116.

Great Britain Search Report of Application No. GB1010982.5, dated Oct. 13, 2012, 4 pages.

European Search Report of Application No. EP10275068, dated Sep. 7, 2010, 6 pages.

* cited by examiner

Figure 4-9 Attenuation of CPW, gap $w$ = 1mm (metallised anti-microbial Ripstop nylon, 0.1 Ω/sq)

Figure 4-8 Measured return loss of 3-stage transformer on cotton cloth

Figure 5-4 Calculated return loss of spiral antenna

ANTENNA STRUCTURE

CROSS-REFERENCE TO RELATED APPLICATIONS

This application is a U.S. National Stage application under 35 USC §371 of PCT/GB2011/000985 filed 29 Jun. 2011, which claims priority under the Paris Convention to European Patent Application 10275068.4 filed 30 Jun. 2010, and British Patent Application 1010982.5 filed 30 Jun. 2010, the entire contents of both applications being incorporated herein by reference.

The present invention relates to a structure for an antenna. Embodiments of the invention find particular application in flexible structures for radio antennas, such as those which can be incorporated into clothing.

Wearable antennas have been developed for use in variety of communications applications. The construction of an antenna using thin, flexible materials has been investigated, giving a lightweight, discrete result which does not hinder the wearer's movements.

There are several challenges in developing a wearable antenna which can for example be incorporated into clothing. Both the antenna and its feed need to be relatively undetectable and also sufficiently robust, for instance to withstand normal movement and handling of the clothing, and washing.

Generally, in practice, antennas require a balanced feed in order to prevent the feed itself from radiating as well as the antenna. If the feed radiates, it reduces the efficiency of the antenna, can distort the radiation/reception pattern and can interfere with other equipment. The output of a radio for use with a wearable communications antenna is unbalanced. It is known to use a transmission line plus a balun to convert the radio output to a balanced antenna feed. Available baluns tend to be easily detectable however.

Spiral antennas are known which have an "infinite balun". These have a feed which winds into the centre of the spiral. They were originally published by J. D. Dyson, for example in 1959 in a paper entitled "The Equiangular Spiral Antenna," in Transactions of the Institute of Radio Engineers. U.S. Pat. No. 5,815,122 discloses a structure of this type. Such arrangements function without an additional balun structure but have significant depth, making them very detectable.

"Spiral" in the context of this specification includes any path on a plane that winds around a fixed centre point at an increasing or decreasing distance from the point. Although the increase or decrease of the distance may be continuous and/or regular, it is not essentially so. The term "spiral" therefore encompasses shapes that might be described as non-circular.

Other constraints with regard to wearable antennas and their feeds are impedance matching, compatibility with broadband operation, delivery of adequate signal power for use in the field, for example 5 Watts or more, and the effect of variable proximity to the body.

According to a first aspect of the present invention, there is provided an antenna assembly for use as a wearable antenna, the antenna comprising at least two spiral arms, one of the arms being constructed to provide a feed structure to a feed connection to at least one other arm in the central region of the spiral antenna, the feed structure comprising a coplanar waveguide.

The arm constructed to provide the feed structure may indeed consist of said coplanar waveguide. That is, the arm comprises slots and a line conductor in a coplanar ground plane, the outer edges of the ground plane providing the width of the arm.

It has been found that such an antenna assembly provides an acceptable performance in spite of a structural difference between the arms.

A spiral antenna of this type does not require a separate balun, benefitting from the "infinite balun" effect mentioned above.

The coplanar waveguide feed structure may provide one or more impedance transforming structures for matching the impedance of a signal feed line, for example from a radio source, to that of the spiral antenna. For example, the ratio of the width of the slots to the width of the line conductor can be changed to alter the impedance of the coplanar waveguide.

In use, the coplanar waveguide will not generally present a flat surface since a wearable antenna may often be subjected to bending or folding. The term "coplanar" is intended to mean a waveguide in which wave-guiding is provided by the feed structure when its elements share a common plane but encompasses such feed structures when bent or folded.

Conveniently, the coplanar waveguide feed structure can easily be designed to provide a quarter wave impedance transformer at the central region of the antenna, where there is a feed connection between the feed structure and the spiral antenna. This can be done by positioning a step change in the ratio of the width of the slots to the width of the line conductor at a point along the slot waveguide which lies one quarter wavelength of the carrier signal wavelength of the antenna, in use, along the waveguide from the feed connection.

Microstrip transmission line feeds using flat conductors give low attenuation and high power handling when the strip width is maximised but this leads to inconveniently low impedance because of the small thickness generally provided by wearable fabrics. Typical, wearable cloth substrates, such as cotton, are often no more than 1 mm thick and can be no more than 0.5 mm or 0.3 mm. A coplanar waveguide for a wearable spiral antenna is best suited to impedances of 75Ω to 125Ω, for instance of the order of 100Ω, where the ratio of the air gap to the conductor width is suitable large and the slot width can be of order 1 mm, reducing the chance of accidental short circuits when the material is crumpled Wearable antennas according to embodiments of the invention have been found to have impedances of 150Ω and above, for example of the order of 190Ω. In this case, the quarter wave impedance transformer described above might be constructed to provide impedance matching between the antenna and a feed structure having an impedance in the range 75Ω to 125Ω, for instance of the order of 100Ω. This allows the bulk of the spiral arm providing the feed structure to be constructed with practical dimensions in respect of slot width while also being integral with a suitable quarter wave impedance transformer at the feed connection.

Typical radio feed lines for wearable antennas have an impedance of about 50Ω. Feed structures used in embodiments of the invention can conveniently provide impedance matching to the feed line as well as to the antenna. For example, the coplanar waveguide feed structure may have an extension with respect to the outer edge of the spiral antenna, which extension provides an impedance matching section for matching the impedance of the coplanar waveguide of the feed structure to that of a signal feed line. For good performance, this extension might be linear and may be tangential to the outer edge of the spiral antenna.

Some spiral antennas have an absorbing cavity behind them. In embodiments of the invention the wearable antenna, or at least the wearable fabric it is constructed on, can be worn close to or against the human body which provides the absorption.

Embodiments of the invention can be constructed in just one plane, on a flexible material, making them difficult to detect, even by a body search, and easily incorporated into clothing. They allow a suitable antenna plus feed structure to be provided in spite of the tight requirements of wearable antennas in terms of detectability, robustness and electrical parameters.

A spiral antenna assembly will now be described as an embodiment of the invention, by way of example only, with reference to the following figures in which:

FIG. 2 shows a cross section taken along the line A-A shown in FIG. 1, viewed in the direction of the arrows, showing the coplanar waveguide of FIG. 1;

Figure 1:
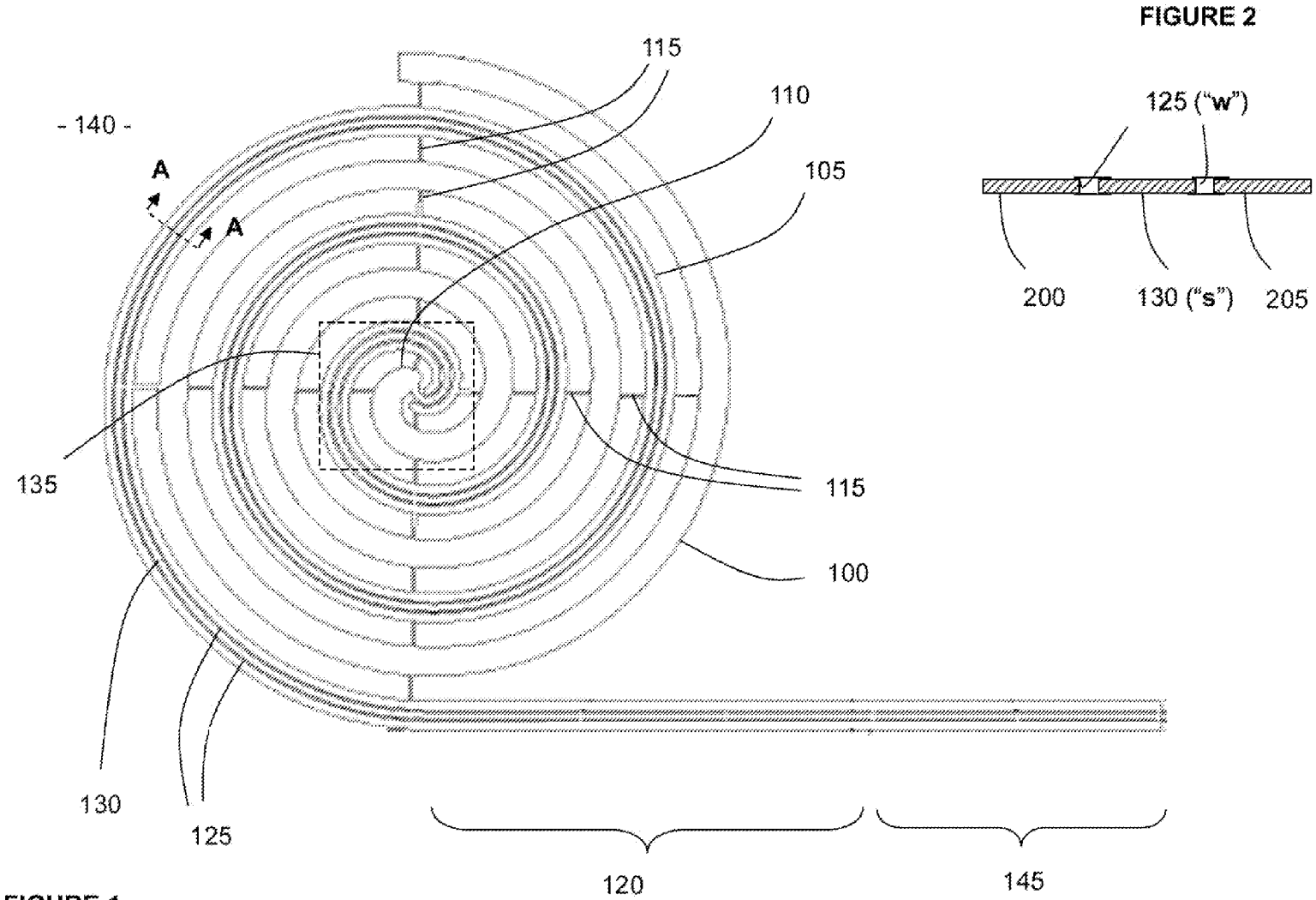
FIG. 1 shows a diagrammatic plan view of a two arm, spiral antenna assembly according to an embodiment of the invention having a coplanar waveguide constructed in one of the arms.

It should be noted that the figures are not drawn to scale.

Referring to FIGS. 1 to 4, a two-arm spiral antenna 100, 105 has a feed structure constructed in one of the arms 105. The two arms 100, 105 are joined at the centre 110 of the antenna and the feed structure comprises a pair of slots 125 and a line conductor 130 in a ground plane 200, 205. The slots 125 effectively give a coplanar waveguide ("CPW") feed line constructed in an arm 105 of the antenna which begins at the outside of the antenna spiral and winds into the centre 110 where the centre conductor 130 has a feed connection 305 to the unmodified arm 100 of the antenna.

Indeed the arm 105 providing the feed structure consists of the feed structure, the outer edges of the ground plane 200, 205 defining the width of the arm 105.

The antenna described here is intended for use with Multi-band Inter/Intra Team Radios ("MBITRs"), these being operable at 5 W power level and providing a 50Ω feed.

The winding of the transmission line around the spiral creates a balanced feed.

There is a requirement for an impedance transformer between the 50Ω impedance of the signal feed line from the radio and that of the antenna which is roughly 200Ω. This can be done in sections of the waveguide feed line by changes in the width of the slots 125. A section adjoining the feed connection 305 of the antenna has the widest slot width, giving a roughly 150Ω impedance, and the outer end of the arm 105 has an extension 145 along a tangent to the antenna where the slots 125 have a reduced slot width in order to match to the feed from the radio. The main length of the feed structure has slots whose width is designed for 100Ω impedance as, in the embodiments described below, these are sufficiently robust in use while allowing a quarter wave transformer to be constructed at the feed connection to the antenna. The gap between the conductors at this impedance is greater than 1 mm which gives a reasonable lack of sensitivity to fabrication errors, crumpling of the material, or damage due to washing, etc.

The antenna is a symmetrical two-arm spiral, so it might be expected that it needs a symmetrical feed at the centre but it has been found unnecessary in embodiments of the invention.

In more detail, the antenna is an Archimedean spiral of known type. The centrelines of the spiral arms are defined by:

$$r = r_0 \frac{\theta}{\theta_0} \exp j\theta$$

where $0 \leq \theta \leq \theta_0$ with outer radius $r_0$=225 □mm and maximum angle $\theta_0$=6 π.

The widths of the arms 100, 105 is 20 mm each, leaving a gap of 17.5 mm between them. The centre conductor 130 of the CPW feed is 5 mm wide. One arm 105 carries the CPW feed, while the other arm 100 is unmodified. The antenna is therefore not quite the Babinet dual of itself, but its input impedance is close to the ideal impedance of a self-complementary antenna, which in this case would be 188 Ω.

The overall diameter of a spiral antenna is usually at least one wavelength at the lowest frequency used. The embodiment described here is of a size that ideally would carry frequencies from about 500 MHz upwards.

In normal usage, with a MBITR radio, a quarter wavelength of the carrier signal in the CPW feed is 210 mm. The angle in the spiral from its centre to the point where s=□210 mm is θ=325°□.

The spiral antenna can be fed in known manner, using a coaxial cable (not shown).

The width of both arms 100, 105 (20 mm) and the width of the centre conductor 130 (5 mm) have been made as large as possible so as to minimise the resistive loss in the feed structure 200, 125, 130, 205. The slots 125 are each 1.25 mm wide, leaving the ground plane conductors 200, 205 each 6.25 mm wide. A centre conductor 130 wider than 5 mm could be used, but the outer ground plane conductors 200, 205 would then be relatively narrow and this might affect the impedance of the CPW feed structure.

The currents associated with the spiral-mode and CPW mode of the antenna are approximately orthogonal. For the radiating spiral mode of the antenna, the currents flow in the same direction on all three conductors 200, 130, 205 of the CPW line. For the CPW mode of transmission, the currents are equal and opposite on the centre and outer conductors.

The antenna is fabricated from a sheet of conductive, flexible material, prior to mounting on a wearable fabric 140. As shown in FIG. 1, it has several fine connecting structures 115 to give it stability during production but these would be removed in the finished antenna.

The material of the antenna may be any suitable conductive material. However, a conductive material for use with wearable fabrics 140 is Nora Dell Nickel-Copper-Silver plated nylon plain weave fabric, manufactured by Shieldex Trading Incorporated, with a quoted average resistivity of 0.005 Ω/sq. The antenna 100, 105 and its impedance matching extension 120, 145 can be laser cut from this material. An important feature of a wearable antenna and its feed is the power handling. For example, in order to handle the 5 W output of an MBITR radio, it is important that materials in the antenna assembly do not overheat. It was found that the spiral antenna assembly was acceptable in this respect, as long as relatively low resistivity material was used and the Nora Dell fabric was good in this respect.

The antenna is mounted on cotton T-shirt style fabric 140. Typical thicknesses of wearable cotton fabric are of the order of 0.3 mm. Although other attachment techniques might be desirable in practice, a working embodiment of the invention can be constructed using adhesive TESA® tape (manufactured by TESA SE) applied to one side of the laser cut Nora Dell material. The backing is removed from the TESA tape and the design can be pressed on to a wearable fabric such as cotton sheet.

The antenna has an expected impedance of 188Ω while the main length of the CPW feed has an impedance of 100Ω. Immediately before the central feed point 305, a quarter-wave transformer of 137Ω is introduced to match the expected impedance of the antenna to the 100Ω feed. The length of this transformer might be any odd multiple of quarter wavelengths, such as three, but in this case is 210 mm, which is one quarter-wavelength at 300 MHz, allowing for the empirically measured velocity factor of 0.84 for CPW on the 0.3 mm cotton fabric. A three quarter-wavelength transformer would only be matched over a narrower bandwidth.

The feed arm 105 has an extension 120, 145 at a tangent for a distance of 500 mm to provide matching to the 50Ω signal feed line of the radio. In more detail, the extension has a first section 120 adjoining the antenna arm 105 which is 300 mm long and maintains the slot width at 1.25 mm, as it is in the arm 105. There is then a second section 145 which is 200 mm long and has a slot width 0.33 mm. The second section 145 steps down the 100Ω impedance of the feed arm 105 to a suitable impedance, approximately 70Ω, for connection to the 50Ω radio feed line.

Figure 4:
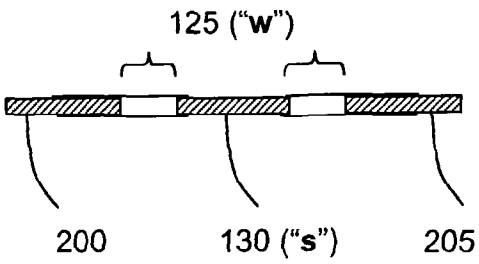
FIG. 4 shows a cross section taken along the line B-B shown in FIG. 3, viewed in the direction of the arrows and showing the narrowed slots of a quarter wave transformer in the waveguide.
Figure 3:
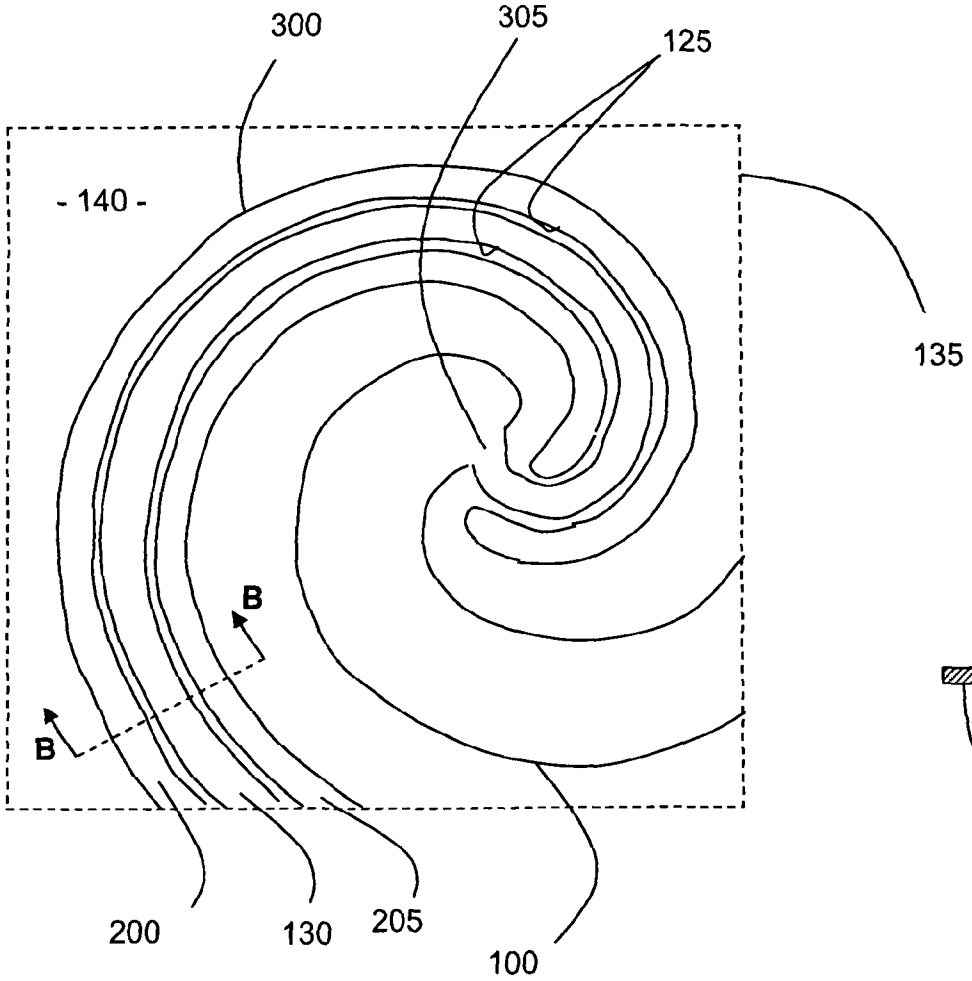
FIG. 3 shows a diagrammatic plan view of the central portion of the antenna assembly of FIG. 1.

Referring to FIGS. 3 and 4, which show the section of the CPW providing the quarter-wave transformer 300, it can be seen that the slots 125 have a wider width "w", this being 2.0 mm. (FIG. 3 shows an enlargement of the box 135 shown in dotted outline in FIG. 1.)

Figure 5:
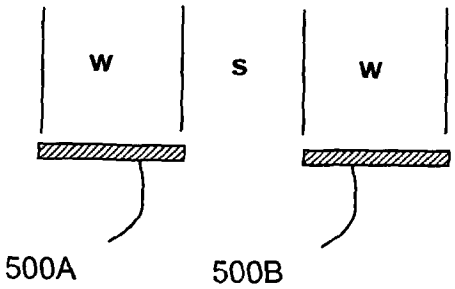
FIG. 5 shows a vertical cross section through an edge-coupled transmission line, the Babinet dual of the two-slot coplanar waveguide of FIG. 1.

Referring to FIGS. 2 and 5, the two slots 125 of the feed line are the Babinet dual of an edge-coupled transmission line having conductors 500A, 500B of width "w" and separation "s". In the feed line shown in FIG. 2, "s" represents the width of the centre conductor 130 and "w" the gap between the centre conductor 130 and the outer ground planes 200, 205.

Figure 6:
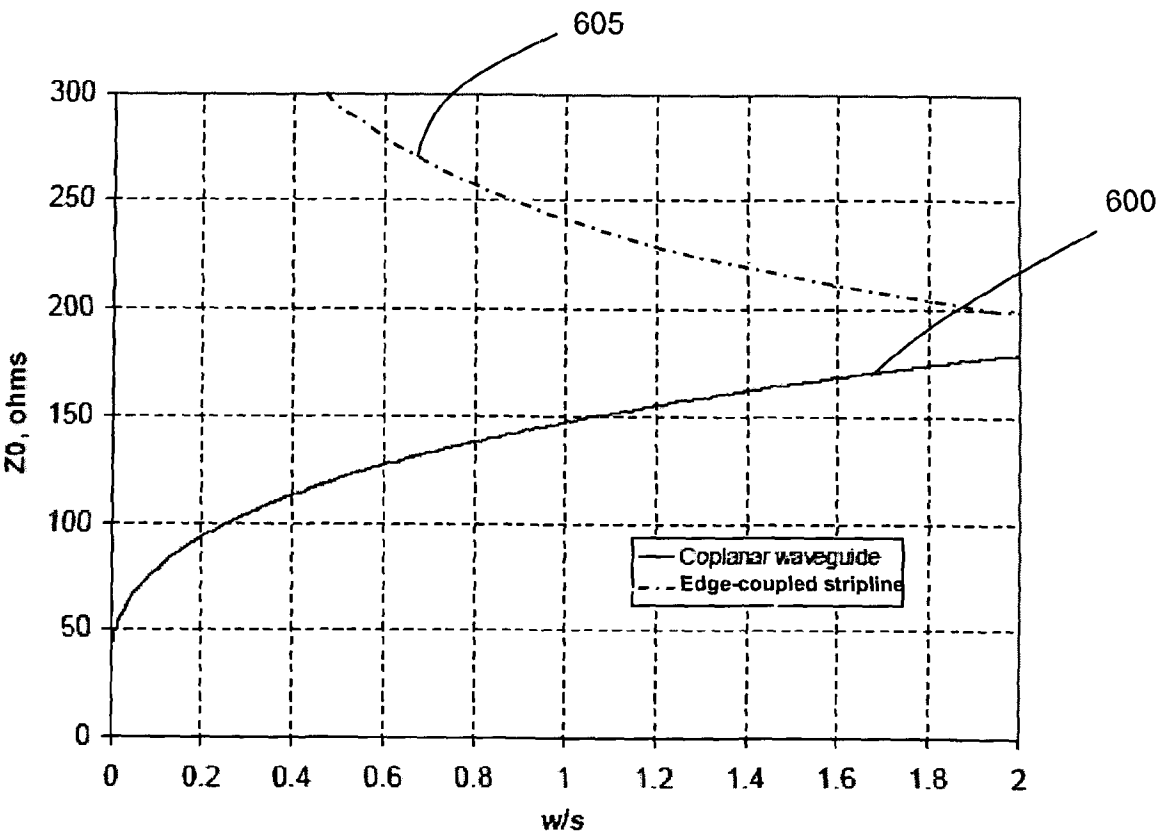
FIG. 6 shows a graph of the impedance of the edge-coupled transmission line of FIG. 5 and the coplanar waveguide of FIG. 1, in terms of the ratio between the conductor (or slot) width "w" and the slot (or conductor) width "s"

Referring to FIG. 6, the impedance 600 of the feed line 200, 130, 125, 205 can be derived from the impedance 605 of the complementary edge-coupled transmission line of FIG. 2. In the latter case, it is known that the impedance is approximately:

$$376.7K(s/(s+2w))$$

when the lines are in vacuum. In FIG. 6, this gives an impedance 600 for the coplanar feed line 200, 130, 125, 205 which, for example, rises above 100Ω at a ratio w/s of approximately 0.26.

Figure 7:
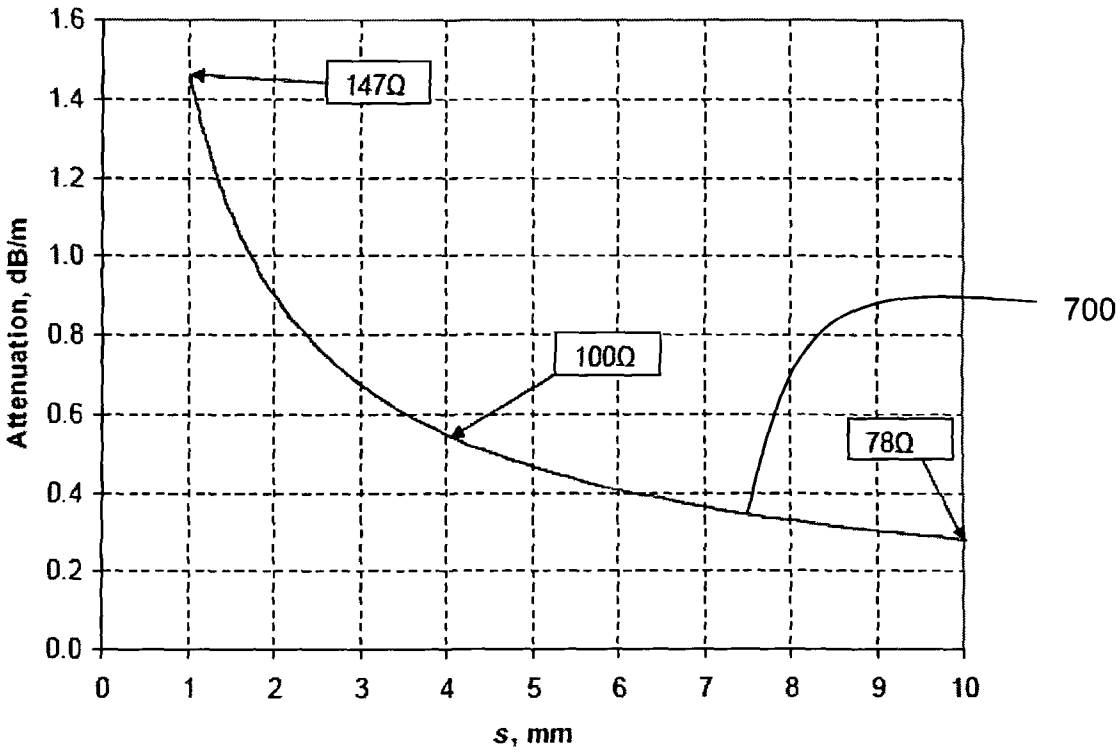
FIG. 7 shows a graph of the attenuation of the coplanar waveguide of FIG. 1 for a fixed slot width "w" and varying conductor width "s"

Referring to FIG. 7, a prototype feed line having a centre conductor of width "s" and slot width "w" was constructed in copper tape on a metallised nylon fabric with a surface resistivity of 0.1 Ω/sq. The attenuation 700 was measured for a fixed slot width "w" of 1 mm and a varying width "s" of the centre conductor 130. For a set of three impedances, the attenuation was approximately as given below:

| | | |
|---|---|---|
| "s" = 10 mm | 78 Ω: | 0.3 dB/m |
| "s" = 4 mm | 100 Ω: | 0.55 dB/m |
| "s" = 1 mm | 147 Ω: | 1.47 dB/m |

It can be seen that there is a trade-off between the size of the structure, and therefore the degree of detectability, and the attenuation. Other factors, in practice, include for example the maximum current for which a conductor is still comfortable to the touch and the minimum slot width (about 1 mm) which is electrically and physically robust enough in use.

Figure 8:
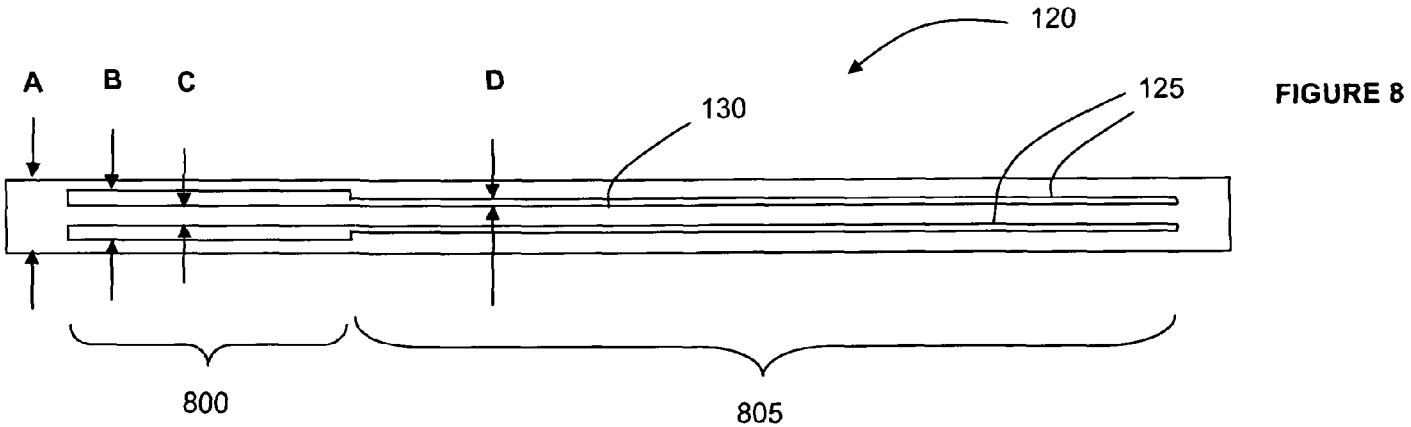
FIG. 8 shows a diagrammatic view from above of a transformer for use at the outer end of the coplanar waveguide of FIG. 1.

Referring to FIG. 8, a further function of the slots 125 is to match the impedance of the antenna to the impedance of the feed to it, which is typically 50Ω. This can be done by stepping the width "w" of the slots 125 from a low value at the outside of the antenna spiral to a higher value at the centre 110. A two-stage transformer is shown in FIG. 8, having a first part 805 where the slot width "w" has a low value and a second part 800 where the slot width "w" has a high value.

In practice, for a prototype antenna, a three stage transformer was constructed, in copper tape on a metallised nylon fabric, in order to match from the 50Ω input line to the approximately 200Ω seen at the feed connection 305 of the antenna. This had a return loss of 20 dB across a 3:1 band. The centre conductor 130 line width was 5 mm. The impedances and slot widths "w" of the three stages were as follows:

| Section | Impedance (Ω) | "w" (mm) |
|---|---|---|
| Input | 50 | 0.055 |
| 1 | 67 | 0.25 |
| 2 | 100 | 1.3 |
| 3 | 150 | 5.4 |

In the above, it can be seen that the input line (50Ω) was connected directly to a 67Ω section of the three-stage transformer. The 0.055 measurement for "w" was found too difficult to realise in the copper tape prototype.

Figure 9:
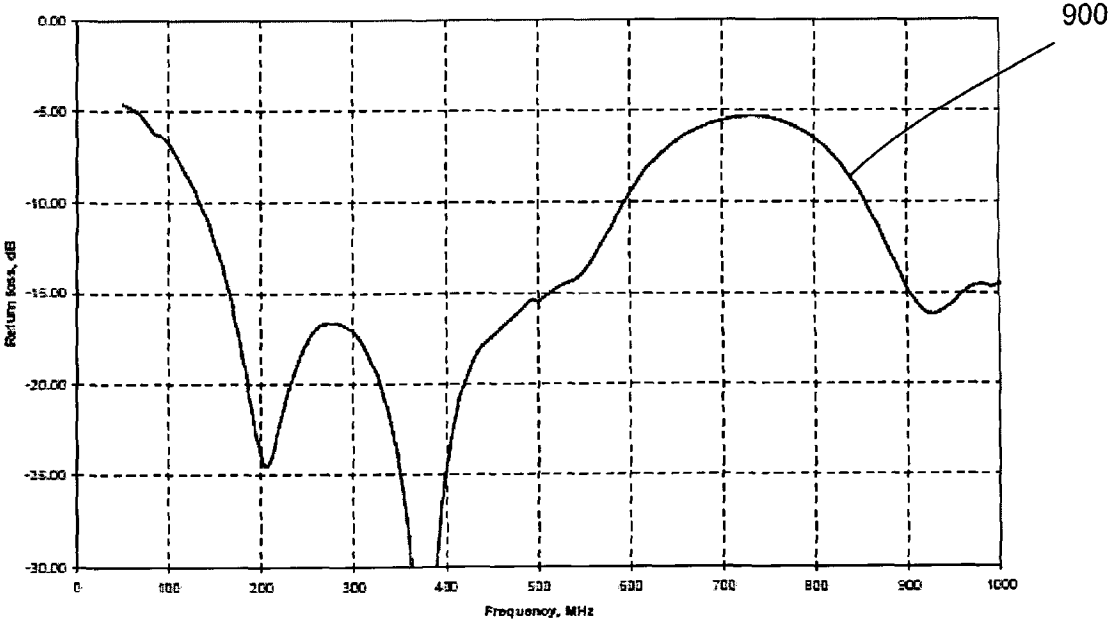
FIG. 9 shows a graph of the measured return loss of a three stage transformer on cotton cloth.

Referring to FIG. 9, in order to measure the return loss 900 of the prototype three-stage transformer, a 200Ω termination was created to represent the antenna. The return loss 900 of the prototype three-stage transformer was substantially as predicted.

Figure 10:
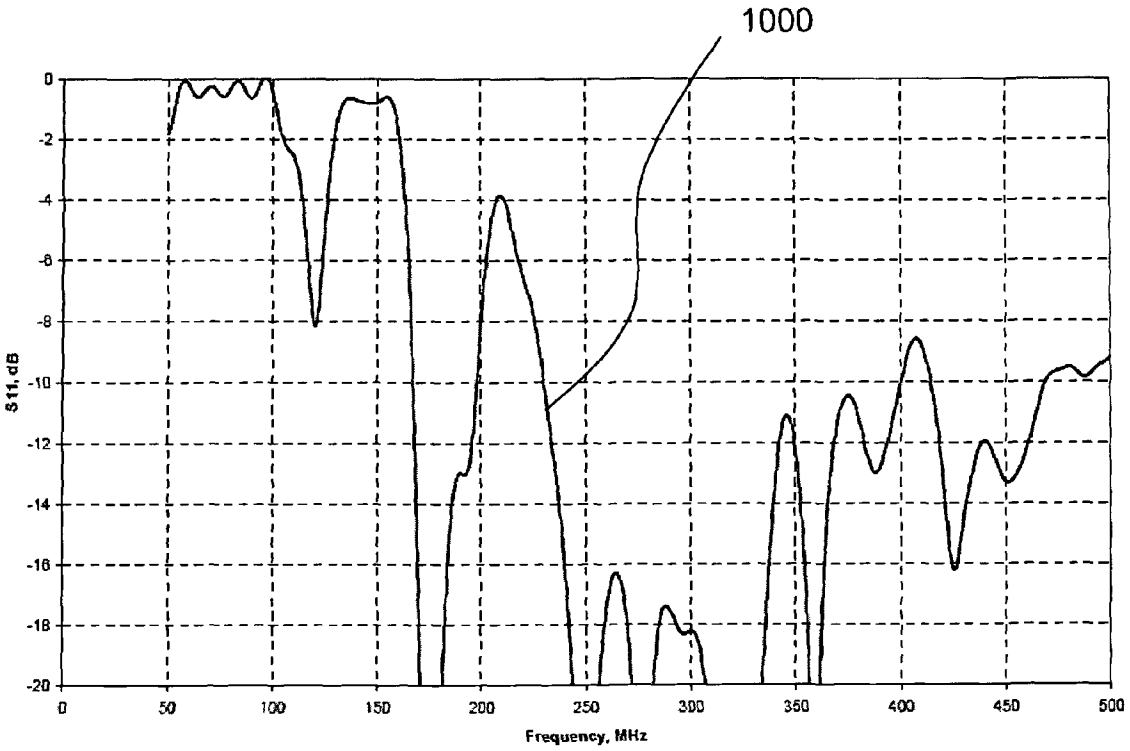
FIG. 10 shows a graph of a predicted return loss of the antenna of FIG. 1.

Referring to FIG. 10, the predicted return loss 1000 of the spiral antenna was found to be lowest in the upper half of the band, that is 250-500 MHz. Efficiency was lower in the lower part of the band, 50-250 MHz, partly as a result of a poorer match to 50Ω and partly because of the small physical size of the antenna in relation to the signal carrier wavelength, in use.

Figure 11:
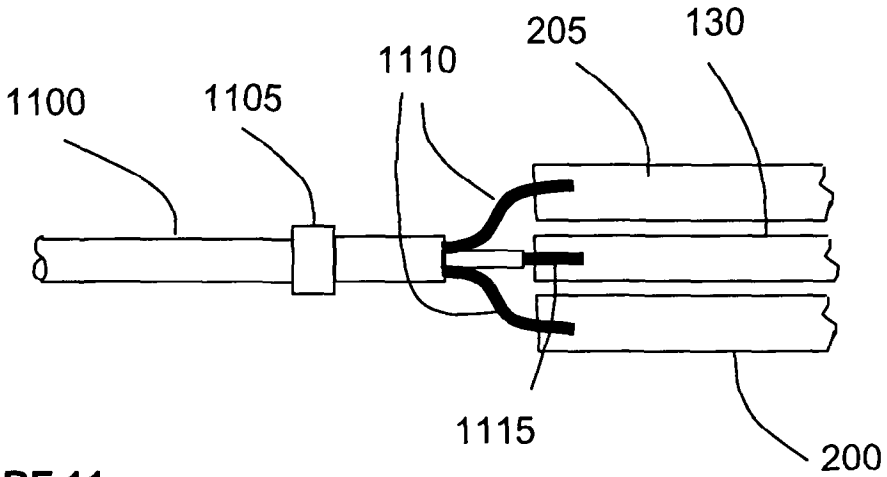
FIG. 11 shows a plan view of an arrangement for connecting the coplanar waveguide of FIG. 1 to a radio.

Referring to FIG. 11, a transmission line 200, 205, 130 connected to an arm 105 in an antenna assembly according to an embodiment of the invention will generally need to be connected to a radio in use. This can be done for example by using a length of coaxial cable 1100 connected to the TNC ("threaded Neill-Concelman") plug of the radio. The free end is held to the wearable fabric 140 (not shown) by using a clip or plastic tie 1105 such as Tywrap® and the outer braid divided into two parts 1110 and attached to the ground plane 200, 205 of the transmission line using a conductive epoxy resin such as silver-filled Araldite®. The inner conductor 1115 is similarly attached to the line conductor 130 of the transmission line.

The invention claimed is:

1. A spiral antenna assembly for use as a wearable antenna, the spiral antenna comprising at least two spiral arms, one of the spiral arms including a feed structure having a coplanar waveguide that terminates near a central region of the spiral antenna assembly and that provides a feed connection to at least one other spiral arm in the central region of the spiral antenna, the at least one other arm being a spiral antenna arm.

2. The spiral antenna assembly according to claim 1 wherein the coplanar waveguide of the feed structure provides one or more impedance transforming structures for matching the impedance of a signal feed line to that of the spiral antenna assembly.

3. The spiral antenna assembly according to claim 1 wherein the coplanar waveguide of the feed structure is a slot waveguide having at least two slots and a line conductor.

4. The spiral antenna assembly according to claim 3, wherein one or more impedance transforming structures for matching the impedance of a feed line to that of the spiral antenna assembly are each provided as a step change in the ratio of slot width to line conductor width.

5. The spiral antenna assembly according to claim 1 wherein the arm constructed to provide a feed structure consists of said coplanar waveguide.

6. The spiral antenna assembly according to claim 1 wherein the coplanar waveguide feed structure provides a quarter wave impedance transformer adjacent to the feed connection.

7. The spiral antenna assembly according to claim 6 wherein the quarter wave impedance transformer provides a match to the impedance at the feed connection from an impedance of the coplanar waveguide in the range 75Ω to 1.25Ω.

8. The spiral antenna assembly according to claim 6, wherein the quarter wave impedance transformer is provided by a step change in the ratio of slot width to line conductor width at a point which lies an odd multiple of a quarter wavelength of the carrier signal of the antenna, in use, along the coplanar waveguide from the feed connection.

9. The spiral antenna assembly according to claim 8 wherein the quarter wave impedance transformer provides a match to the impedance at the feed connection from an impedance of the coplanar waveguide in the range 75Ω to 125Ω.

10. The spiral antenna assembly according to claim 1 wherein the coplanar waveguide of the feed structure has an extension with respect to the outer edge of the spiral antenna, which extension provides an impedance matching section for matching the impedance of the coplanar waveguide of the feed structure to that of a signal feed line.

11. The spiral antenna assembly according to claim 10 wherein said extension is tangential to the outer edge of the spiral antenna.

12. The spiral antenna assembly according claim 10 wherein the coplanar waveguide has an impedance in the range 75Ω to 125Ω which is matched by the quarter wave impedance transformer to the impedance at the feed connection and by the extension to a 50Ω signal feed line.

13. A spiral antenna assembly comprising at least two spiral arms, one of the spiral arms including a feed structure having a coplanar waveguide that terminates near a central region of the spiral antenna assembly and that provides a feed connection to at least one other spiral arm in the central region of the spiral antenna, for use at radio frequencies.

14. A spiral antenna assembly comprising at least two spiral arms, one of the spiral arms including a feed structure having a coplanar waveguide that terminates near a central region of the spiral antenna assembly and that provides a feed connection to at least one other spiral arm in the central region of the spiral antenna, the coplanar waveguide constructed from a conductive, flexible material for attachment to a wearable fabric.

15. A garment comprising a spiral antenna assembly, the spiral antenna comprising at least two spiral arms, one of the spiral arms including a feed structure having a coplanar waveguide that terminates near a central region of the spiral antenna assembly and that provides a feed connection to at least one other spiral arm in the central region of the spiral antenna.

* * * * *